US006659433B2

(12) United States Patent
Kusano et al.

(10) Patent No.: US 6,659,433 B2
(45) Date of Patent: Dec. 9, 2003

(54) HUMIDIFIER

(75) Inventors: Yoshio Kusano, Saitama (JP); Hiroshi Shimanuki, Saitama (JP); Toshikatsu Katagiri, Saitama (JP); Motohiro Suziki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 85 days.

(21) Appl. No.: 09/943,818

(22) Filed: Aug. 31, 2001

(65) Prior Publication Data

US 2002/0024155 A1 Feb. 28, 2002

(30) Foreign Application Priority Data

Aug. 31, 2000 (JP) ..... P2000-264703

(51) Int. Cl.[7] ..... B01F 3/04
(52) U.S. Cl. ..... 261/102; 261/104
(58) Field of Search ..... 261/96, 99, 102, 261/104; 95/52; 96/8

(56) References Cited

U.S. PATENT DOCUMENTS 3,228,876 A * 1/1966 Mahon ..... 261/104
5,762,684 A * 6/1998 Hayashi et al. ..... 96/8
6,471,195 B2 * 10/2002 Shimanuki et al. ..... 261/44.1
2001/0015500 A1 * 8/2001 Shimanuki et al. ..... 261/104
2001/0015501 A1 * 8/2001 Katagiri et al. ..... 261/104

FOREIGN PATENT DOCUMENTS

JP 2001-202977 7/2001

* cited by examiner

*Primary Examiner*—C. Scott Bushey
(74) *Attorney, Agent, or Firm*—Lahive & Cockfield, LLP

(57) ABSTRACT

A small and simple humidifier includes at least one hollow fiber membrane module formed by inserting into a cylindrical housing, both ends of which are opened, a bunch of water-permeable hollow fiber membranes along the axis of the housing, fixing both ends of the bunch at the outer circumference sides onto both ends of the housing at the inner circumference sides using a resin to thereby block the ends of the housing so as to form a plurality of peripheral apertures which are communicated within the housing at several intervals in the circumferential direction. The humidifier also includes a first passage which allows gas for flowing from one end of the peripheral apertures to the other end thereof serving as an inlet and an outlet, and a second passage which allows gas for flowing from one end to the other end of the bunch of the hollow fiber membrane. The first passage and the second passage are sectioned by a plurality of overlapped plates in an indentation state.

3 Claims, 8 Drawing Sheets

HUMIDIFIER

RELATED APPLICATIONS

This application claims priority to Japanese Patent Application No. 2000-264703 filed on Aug. 31, 2000 in Japan. The contents of the aforementioned application are hereby incorporated by reference.

FIELD OF THE INVENTION

The present invention relates to a humidifier to isolate moisture in a gas with hollow fiber membranes.

BACKGROUND OF THE INVENTION

As humidifier which exchanges moisture with this species of hollow fiber membrane, this applicant is proposing a humidifier (Japanese Laid-open Patent Publication No. 2001-202977).

FIGS. 8 and 9 are indicating this humidifier 50, a plurality of hollow fiber membrane modules 52 are supported in a pair of head block 51. Each hollow fiber membrane module 52 is comprised of the structure that the bunch of water permeable hollow fiber membrane 54 (herein after called as hollow fiber membrane) is axially inserted into a cylindrical housing 53 in which the both ends are opened, and both ends of the bunch of hollow fiber membrane 54 are stuck through a resin in the inner face of both ends of a cylindrical housing 53, and what is more, a plurality of peripheral aperture 55 which becomes inlet and outlet port for gas is peripherally established at interval on the both end of peripheral portion of housing 53 of each hollow membrane module 52.

A pair of head block 51 are supported by inserting said hollow fiber membrane module 52 into between each supporting hole 56 opening in the inner face of head block 51. Therefore, when a pair of head block 51 is connected together, a plurality of peripheral apertures 55 established in both ends of each peripheral housing 53 are consecutively pierced into the expanded cylindrical first chamber 58 in the center portion of supporting hole 56 of each head block 51, apertures in both end of each hollow fiber membrane 54 are consecutively pierced into second chamber 59 which is sectioned inside of each head block 51.

Each first chamber 58 and second chamber 59 is consecutively pierced into the first passage 60 and the second passage 61 respectively through the first common passage 62 and the second common passage 63 sectioned in each head block 51 respectively. This causes moisture in humid gas to move to peripheral surface of each hollow membrane 54 due to capillary phenomenon (capillary condensation phenomenon) when high humidity gas is supplied into the second passage 61 while low humidity gas (including a dry gas) is supplied into the first passage 60, consequently, this moisture humidifies low humid gas circulating through the first passage 60.

In this way, said humidifier 50 sections the first passage 60, the second passage 61, the first common passage 62, the second common passage 63, the first chamber 58, the second chamber 59 and a supporting hole 56 in a pair of head block 51, and then the first passage 60 and the second passage 61 are communicated with the housing 53 of each hollow fiber membrane module 52 and each hollow fiber membrane 54 through the first chamber 58 and the second chamber 59 respectively, however, end mill machining or drill machining is indispensable to form said first passage 60 and the second passage 61, etc in one head block 51, what is more, boring machining by boring lathe is indispensable to form the first chamber 58 and the second chamber 59. Therefore, these cause complication and increasing man-hour, consequently it is not provided inexpensively.

Furthermore, said humidifier 50 is adopting the structure to communicate the first passage 60 with housing 53 of hollow fiber membrane module 52 through the first chamber 58 and a plurality of peripheral aperture 55, but even though a route section is invariable, a pressure loss is occurred in response to the distance from the joint portion of the first passage 60 and the first common passage 62 to each first chamber 58 and the circumferential distance from the first chamber 58 to each peripheral aperture 55, which causes a flow rate disproportion, consequently, moisture exchanging rate is variable in every each hollow fiber module 52.

For the reason of this, pressure loss must be decreased by enlarging route section of the first passage 60,the second passage 61, the first common passage 62, the second common passage 63, the first chamber 58 and the second chamber 59, but end mill machining or drill machining and boring machining to form holes for an object of rotation can not help for enlarging a diameter of establishing hole, consequently, these can not contribute to downsizing and lightening a head block 51.

What is more, In said humidifier 50, connecting the second passage 61 to the second common passage 63 communicating with between each second chamber 59 for communication allows the gas for moisture exchanging to circulate in each hollow fiber membrane 54 of each hollow fiber membrane module 52, however, when assuming a pressure loss at the passage based on the joint point of the second passage 60, the flow rate of each hollow fiber membrane 54 is different respectively.

For the reason of this, a diameter of establishing hole to form the second passage 61, the second passage 63 and the second chamber 59 can not help for expanding to enlarge the head block 51 to cope with a pressure loss by end mill machining or drill machining and boring machining.

Besides, this applicant is proposing another humidifier in (Japanese Laid-open Patent Publication No. 2001-202977). This humidifier is supporting a plurality of hollow fiber membrane modules on a pair of bulkheads positioned at intervals each other to comprise a head block which sections said first passage and the second passage with the bulkhead at the left, right, up and down. However, this is not sufficient to solve said object.

The primary object of the present invention is to make simple structure, easy manufacturing and assembling. Furthermore, the second object of the present invention is to practically improve the moisture-exchanging rate of a humidifier.

SUMMARY OF THE INVENTION

The present invention is proposed to attain the primary object, and is to provide a humidifier comprised of a cylindrical housing in which a plurality of hollow fiber membranes inserted therein and a plurality of peripheral apertures disposed thereon are established and both ends of the housing are opened, a first plate having a dent portion on a part of the surface, and a second plate having a dent portion on a part of the surface, in addition, a plurality of plates including said first and second plates being overlapped whereby the dent portion of said first plate forms a first passage and the dent portion of said second plate forms a second passage, and said first passage being connected to said peripheral apertures and said second passage being connected to both ends of said open ends of the housing whereby moisture-exchange between a first fluid passing through said first passage to be introduced into the outside of said hollow fiber membranes and a second fluid passing through said second passage to be introduced into the inside of said hollow fiber membranes. That is to say, when said first passage and second passage are sectioned by denting a contact surface of a plurality of plate polymerized each other, these two passage can be formed under the condition to have made open the first passage and the second passage out.

This allows the first passage and the second passage to be formed and assembled easily with machining, casting and press working. Of course forming said first passage and second passage with casting or press working is less expensive.

Furthermore, the present invention may provide a humidifier comprised of at least one hollow fiber membrane module formed by inserting into a cylindrical housing, both ends of which are opened, a bunch of water-permeable hollow fiber membrane along the axis of said housing, fixing both ends of said bunch at the outer circumference sides onto both ends of said housing at the inner circumference sides by means of a resin to thereby block the ends of said housing so as to form a plurality of peripheral apertures which are communicated within said housing at several intervals in the circumferential direction, a first passage which allows gas for flowing from one end of said peripheral apertures to the other end thereof serving as an inlet and an outlet, and a second passage which allows gas for flowing from one end to the other of the bunch of said hollow fiber membrane, and what is more, in aforementioned, said first passage and said second passage being sectioned by a plurality of overlapped plates having indentation portions.

That is to say, when said first passage and second passage are sectioned by denting a contact surface of a plurality of plate polymerized each other, these two passage can be formed under the condition to have made open the first passage and the second passage out.

This allows the first passage and the second passage to be formed and assembled easily with machining, casting and press working. Of course forming said first passage and second passage with casting or press working is less expensive.

What is more, the present invention provides a humidifier wherein a lower portion of said first passage for allowing the gas for flowing towards respective peripheral apertures formed on one end of said housing is formed in a chamber state which surrounds the respective peripheral apertures along with the circumferential direction in such a manner that the flowing rate become the same at all cross-sections of said first passage from the upstream to the downstream, and an upper portion of said first passage for allowing the gas for flowing towards respective peripheral apparatuses formed on one end of said housing is formed in a chamber state which surrounds the respective peripheral apertures along with the circumferential direction in such a manner that the flowing rate become the same at all cross-sections of said first passage from the upstream to the downstream.

That is to say, in order to discharge a gas penetrating into inside of the housing via each peripheral aperture formed in one end of the housing from each peripheral aperture formed in the other end of the housing, it is assumed that the down stream of the first passage to inflow gas into a plurality of peripheral aperture of one end of housing is concentrically formed for a plurality of peripheral aperture, meanwhile, the up stream of first passage to inflow a gas from a plurality of peripheral aperture of the other side of housing is concentrically formed for peripheral aperture of other portion of this housing.

However, since a gas streaming around a plurality of peripheral aperture of one end of housing is sequentially coming into a peripheral aperture of down stream from that of up stream, flow velocity of gas streaming around each peripheral aperture and a pressure distribution around each peripheral aperture of one end of housing is varied, consequently, inlet pressure of peripheral aperture of the down stream is decreased compared with inlet pressure of that of up stream. What is more, since outlet pressure for a plurality of peripheral aperture of other end of housing is also proportional to inlet pressure, inflow of gas in housing is disproportionate. Accordingly, in related structure, inlet and outlet flow rate of gas for the housing is decreased, and moisture exchanging for a plurality of hollow fiber membrane in housing is disproportionate, an improvement in moisture exchanging rate of whole equipment can not be expected.

Therefore, the present invention materializes the equalization of inlet pressure for each peripheral aperture of one end of the housing as equalization of flow velocity (inflow velocity) of the down stream of the first passage for a plurality of peripheral apertures of one end of said housing, specifically, as invariable inlet velocity for each peripheral aperture by comprising said downstream so that velocity is uniformed even in every route section from the upstream to the downstream for each peripheral aperture of the downstream portion of this first passage, in the meantime, for each peripheral aperture formed on one edge of said housing, forming the downstream portion of said first passage to inflow gas as chamber shape radially surrounding each peripheral aperture.

Furthermore, the outlet pressure of each peripheral aperture of one end of the housing is equalized to allow gas to uniformly stream in the housing by forming the up stream portion of chamber of said first passage to discharge gas for each peripheral apertures of the other end of said housing so that flow velocity is uniformed even in every route section from the up stream to the down stream for each peripheral apertures.

This allows moisture to be equally exchanged for a planarity of hollow fiber membrane stored in the housing to improve a moisture-exchanging rate in the whole of equipment.

DESCRIPTION OF THE PREFERRED EMBODIMENTS

Figure 1:
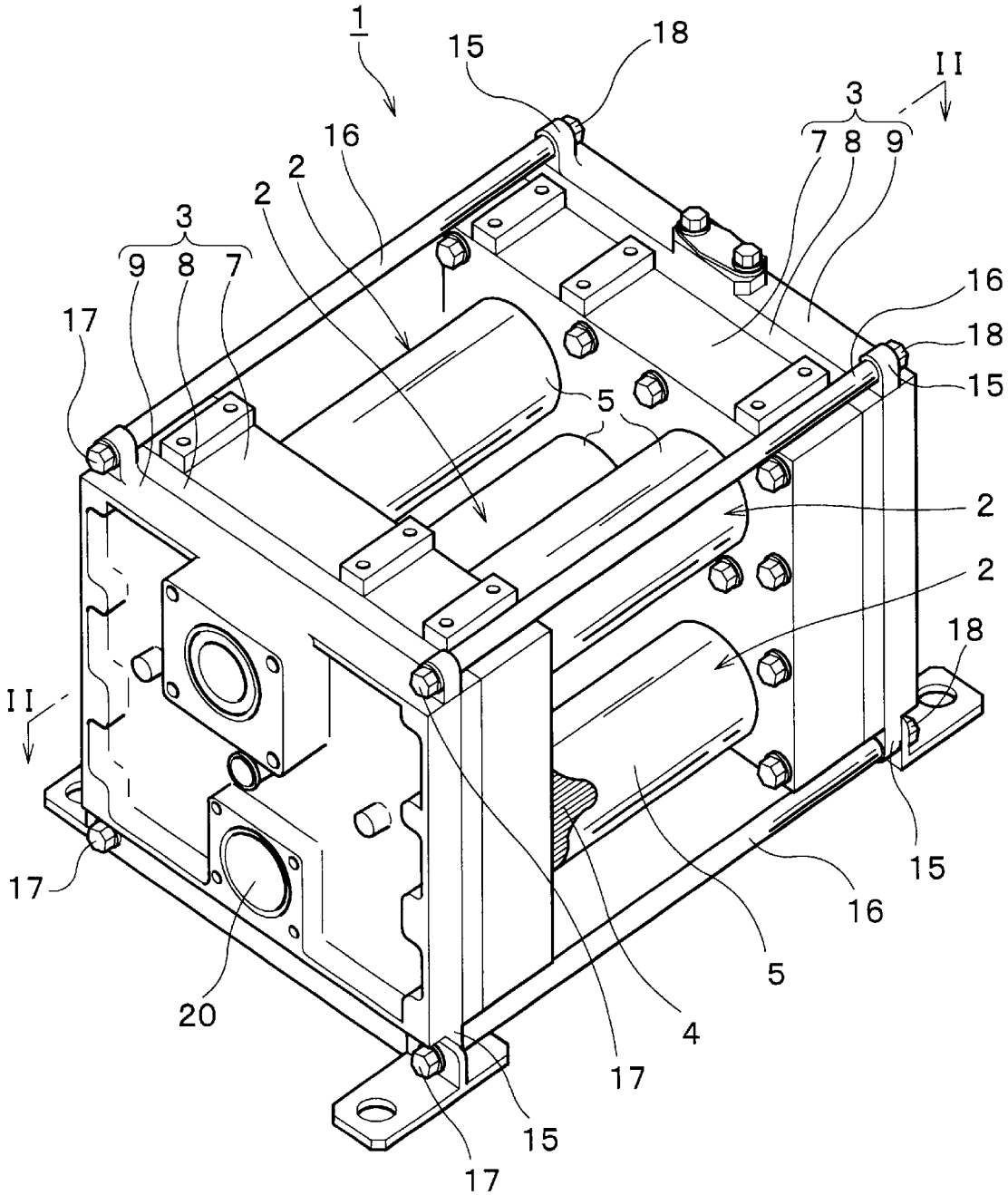
FIG. 1 illustrates one embodiment of the present invention and a perspective view to show a humidifier.
Figure 2:
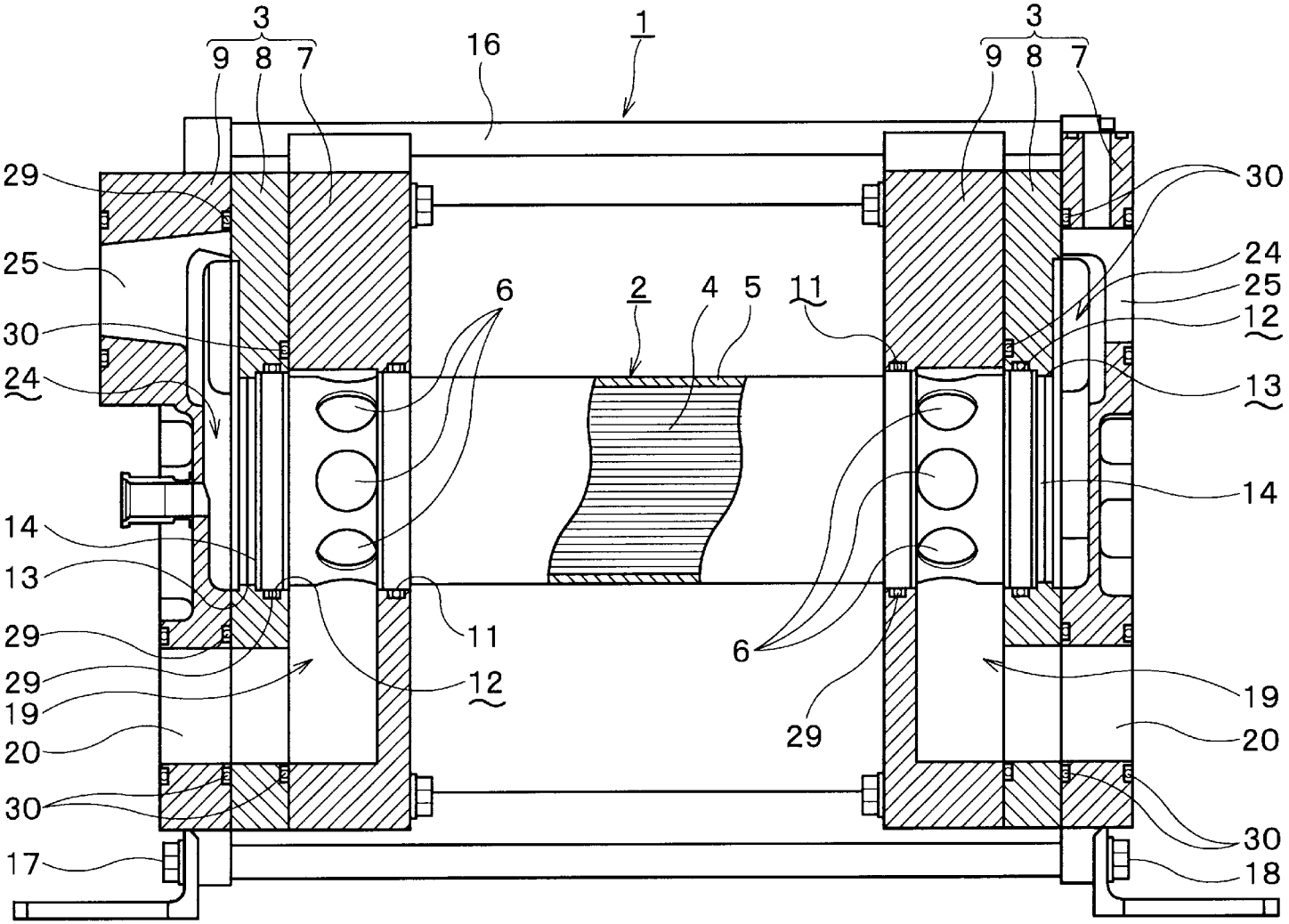
FIG. 2 illustrates one embodiment of the present invention and II—II line cross sectional view of FIG. 1.

Following is an explanation with reference to the appendix view of the embodiments of the present invention. FIG. 1 is a perspective view of humidifier regarding to the embodiment. FIG. 2 is the structure of a humidifier. As indicating in FIG. 1, a humidifier 1 is comprised of a plurality of hollow fiber membrane module 2 and a pair of head block 3 to circulate gas in hollow fiber membrane module 2 in which each head block has different humidity, and said hollow membrane module 2 is comprised of multiple bunches of hollow fiber membrane 4 and a cylindrical housing 5 to fill a bunch of these hollow fiber membrane 4. A plurality of hollow fiber membrane 4 extends from one side end to the other respectively along an axial direction of housing 5, both end of peripheral portion is tightly stuck in the inner face of both end of cylindrical housing 5 under the condition of being banded by a potting with resin. A plurality of peripheral aperture 6 to pierce between inside and outside of housing 5 is circumfentially formed at interval on both ends of peripheral housing 5 of each hollow fiber membrane module 2.

A pair of said head block 3 is separated into a plurality of plate respectively to improve the manufacture-ability and the construction. Regarding to the embodiment, a pair of said head block 3 is separated into three plates of inside plate 7, intermediate plate 8, and outside plate 9 respectively, and is comprised of sequentially polymerizing these ones.

A shaft hole 11, 12 to insert and to support the end portion of said hollow fiber membrane module 2 is formed in said inside plate 7 and intermediate plate 8, a fit shaft portion with facet joint 14 fitting into a fit hole portion with facet joint 13 formed on the head portion in inserting direction of a shaft hole 12 of said intermediate plate 8 is formed in both end of each housing 5, and a mounting boss 15 for connecting these head block 3 on the upper face of a pair of head block 3 is integrally formed.

For the reason of this, collar 16 is allocated in between mounting bosses 15 facing each other, when nut 18 is screwed and clamped in the head of connecting bolt 17 inserted into a mounting boss 15 facing to this collar 16, integrating each hollow fiber membrane modules 2 without losing for a pair of head block 3 can be practical.

Figure 3:
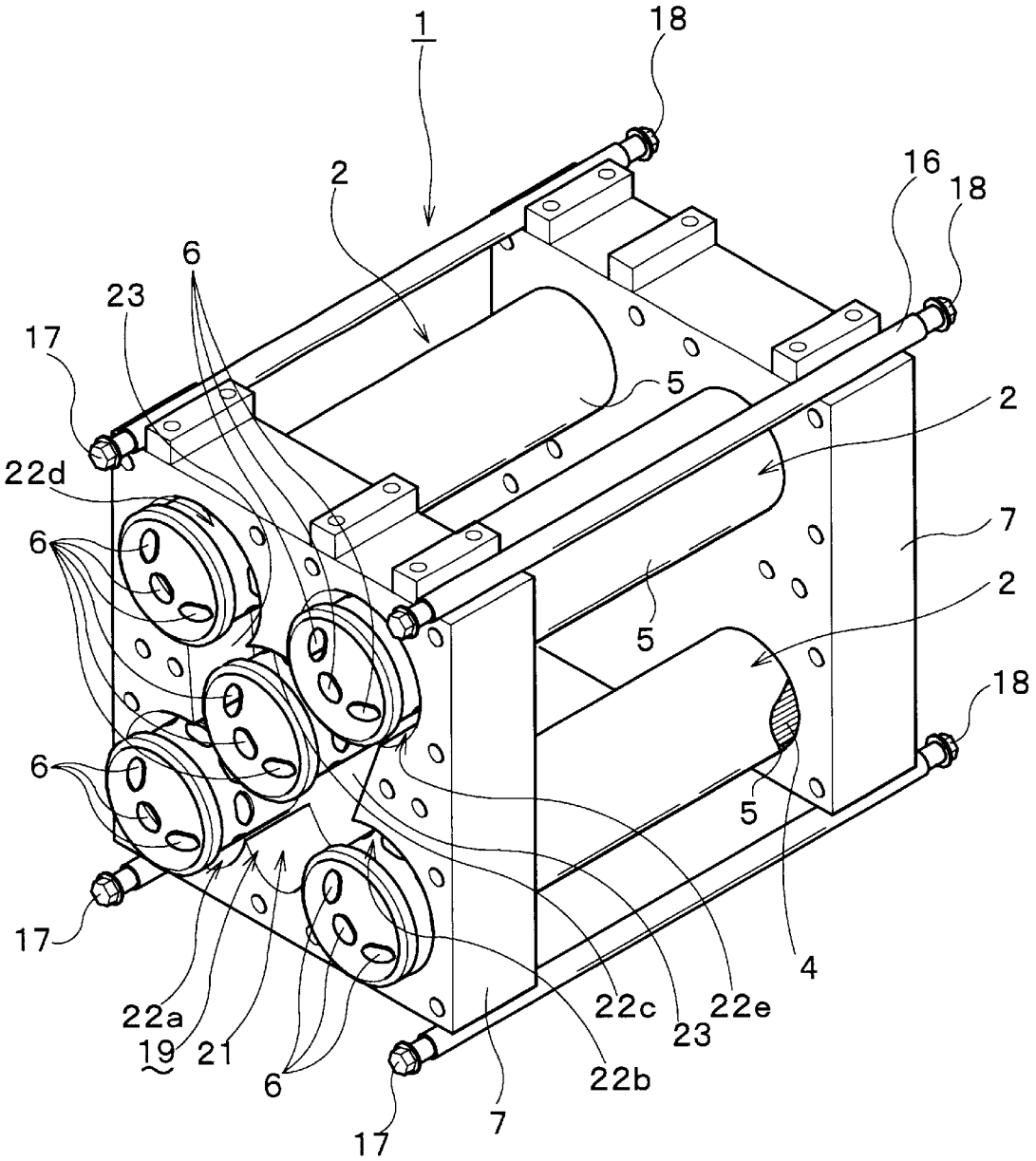
FIG. 3 illustrates the embodiment of the present invention and a perspective view to show a humidifier.
Figure 4:
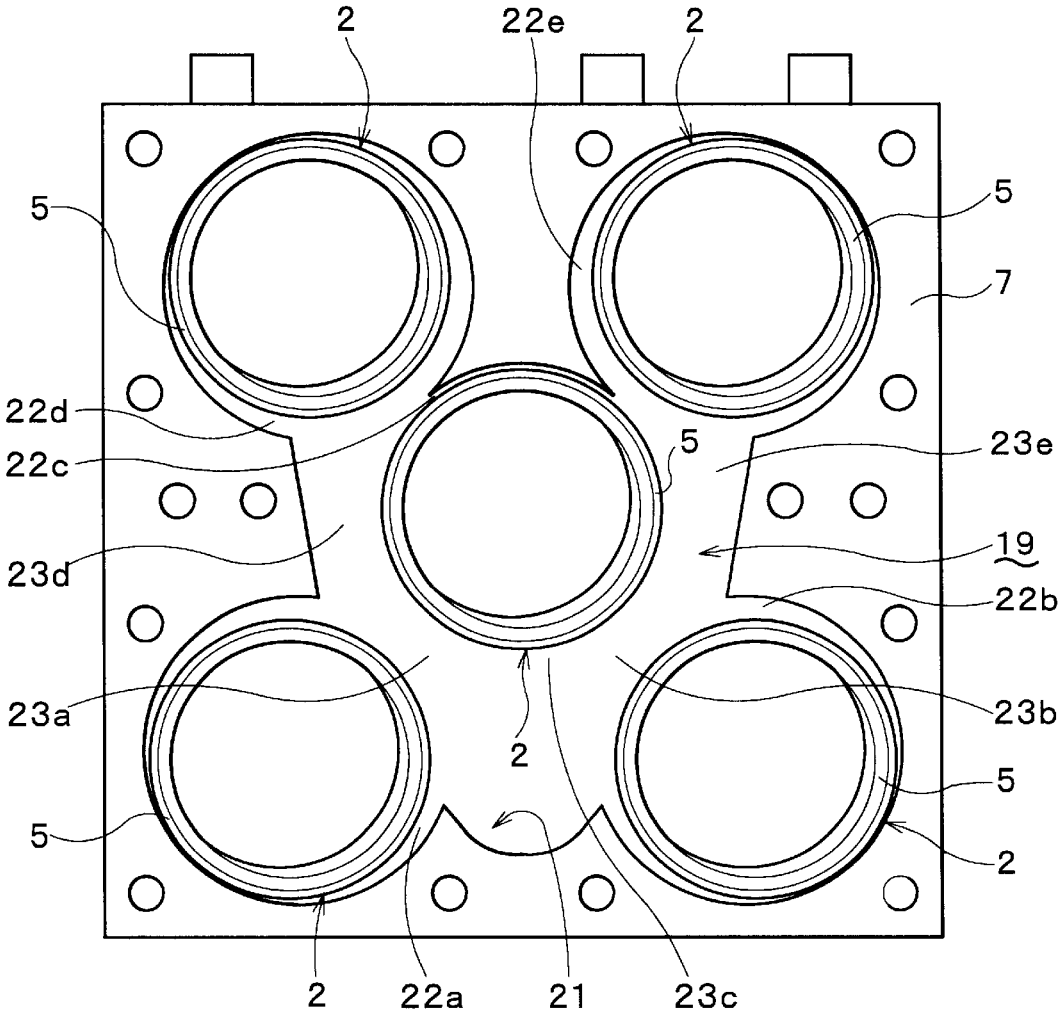
FIG. 4 is a front view of inside block seen from intermediate block side in humidifier regarding to one embodiment of the present invention.

As shown in FIG. 2, the first passage 19 is sectioned in said head block 3 to circulate gas (low humidity gas) from one side to other so that a plurality of peripheral aperture 6 on one side of housing 5 of a hollow fiber membrane module 2 is inlet or outlet, the other side of a plurality of peripheral aperture 6 is outlet or inlet. FIGS. 3 and 4 indicates the first passage 19 under the condition of expelling intermediate plate 8. As indicating in FIGS. 2, 3 and 4, said first passage 19 is formed by denting a connecting face of said inside plate 7.

Said first passage 19 is comprised of the first gas inflow portion 21 to communicate with an inlet and outlet port 20 for gas of outside plate 9, a plurality of first chamber 22*a*~22*e* to circulate gas into a plurality of peripheral aperture 6 of each housing 5 and the first common passage 23*a*~23*e* to make chamber 22*a*~22*e* communicate with the first gas inflow portion 21, opening the separating each wall sectioned the first common passage 23*a*~23*e* and each first chamber 22*a*~22*e* allows the both side to communicate with each other, and opening the separating each wall between the first gas inflow portion 21 and the first common passage 23*a*, 23*b*, 23*c* allows the both side to communicate with each other. Subsequently, the depth of dent of said first gas inflow portion 21, said first chamber 22*a*~22*e* and said first common passage 23*a*~23*e* is equally established each other, and the wide of passage of the first common passage 23*a*~23*e* is established in response to an unification of inflow to circulate into the first chamber 22*a*~22*e*.

Said first chamber 22*a*~22*e* is formed so that the flow velocity is uniformed even in every route section from the up stream to the down stream for each peripheral aperture 6 formed in one end of said housing 5 to unify a gas velocity streaming around a plurality of peripheral aperture 6 of one end of said housing 5 to comprise so as to equalize inlet pressure for peripheral aperture 6 of one end of housing 5.

Figure 5:
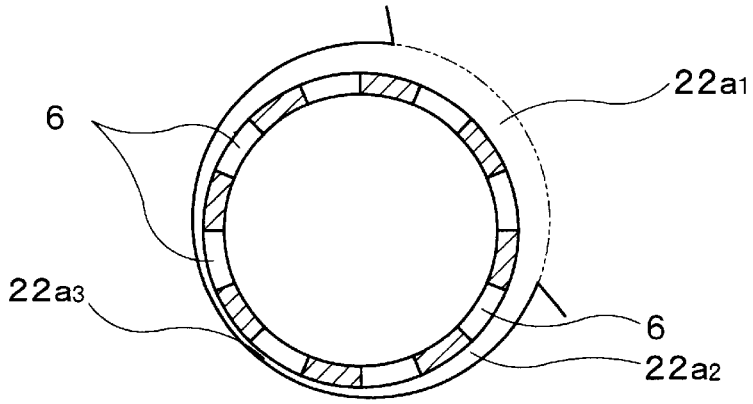
FIG. 5 illustrates one embodiment of the present invention and a necessary part of detailed view to explain gas streaming for the first chamber.

Concretely, attention to the first chamber 22*a* indicated in FIG. 5 as example, the flow passage 22*a*1~22*a*3 formed in between the first chamber 22*a* and hollow fiber module 2 is formed so that while making a depth identical, a flow passage 22*a*1 which is the nearest said outlet and inlet portion 20 is the widest, narrows gradually and a flow passage 22 which is the farthest from said outlet and inlet portion is formed to become the narrowest.

That is to say, the father one it is, it forms the route section of 22*a*3 smaller from 22*a*1, the one, which is nearer, said outlet and inlet 20 it is, are bigger.

According to this structure, for example, a flow rate flowing from the first common passage 23*a* gradually reduces by being induced into peripheral apertures 6 of hollow fiber membrane module 2, meanwhile, the velocity become unify without decreasing by a reduction of cross-sectional area corresponding to this decrease, consequently, the proportional pressure to peripheral apertures 6 is uniformed.

Figure 6:
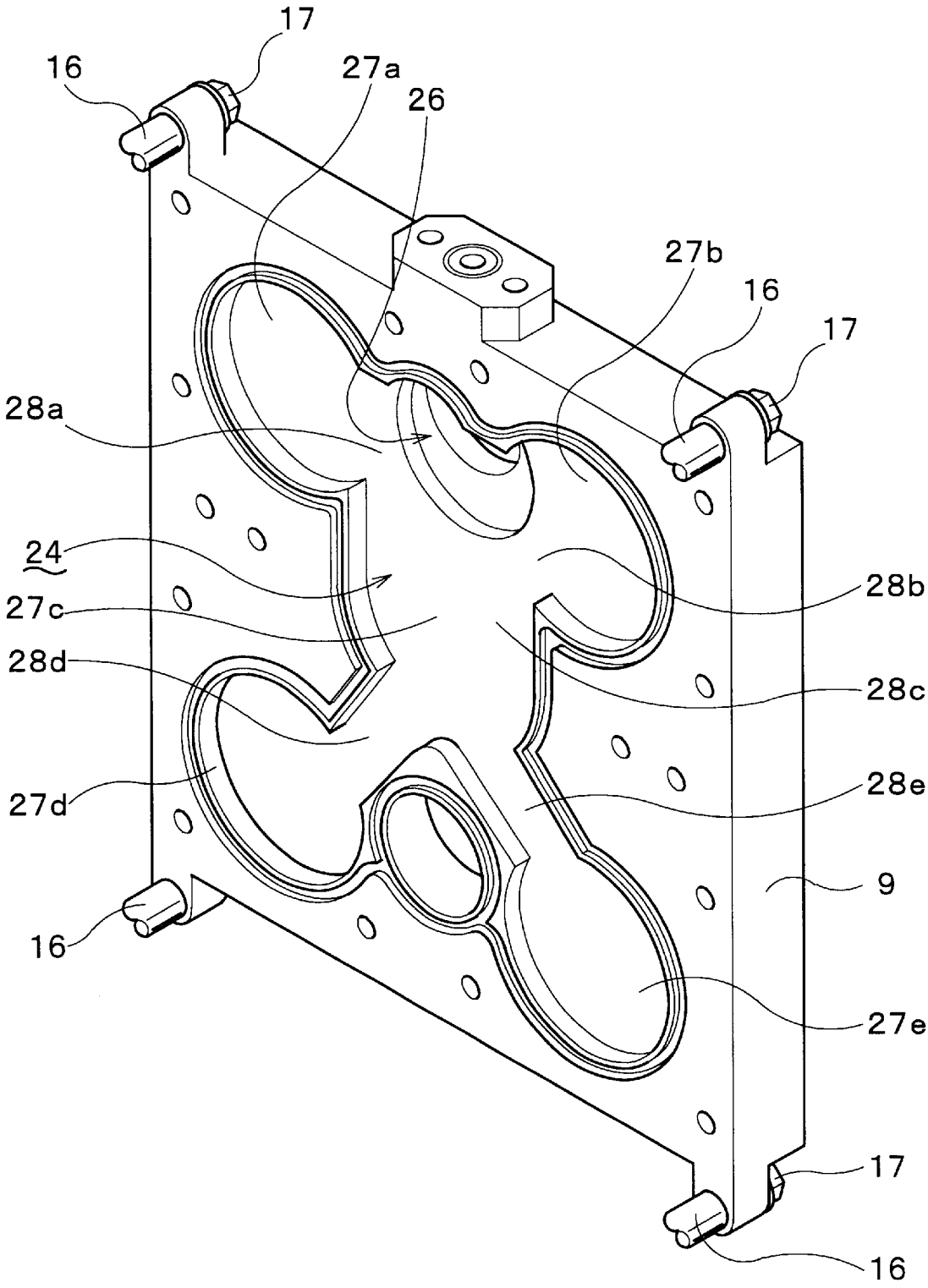
FIG. 6 is a perspective view of inside block seen from intermediate block side regarding to the present invention.
Figure 7:
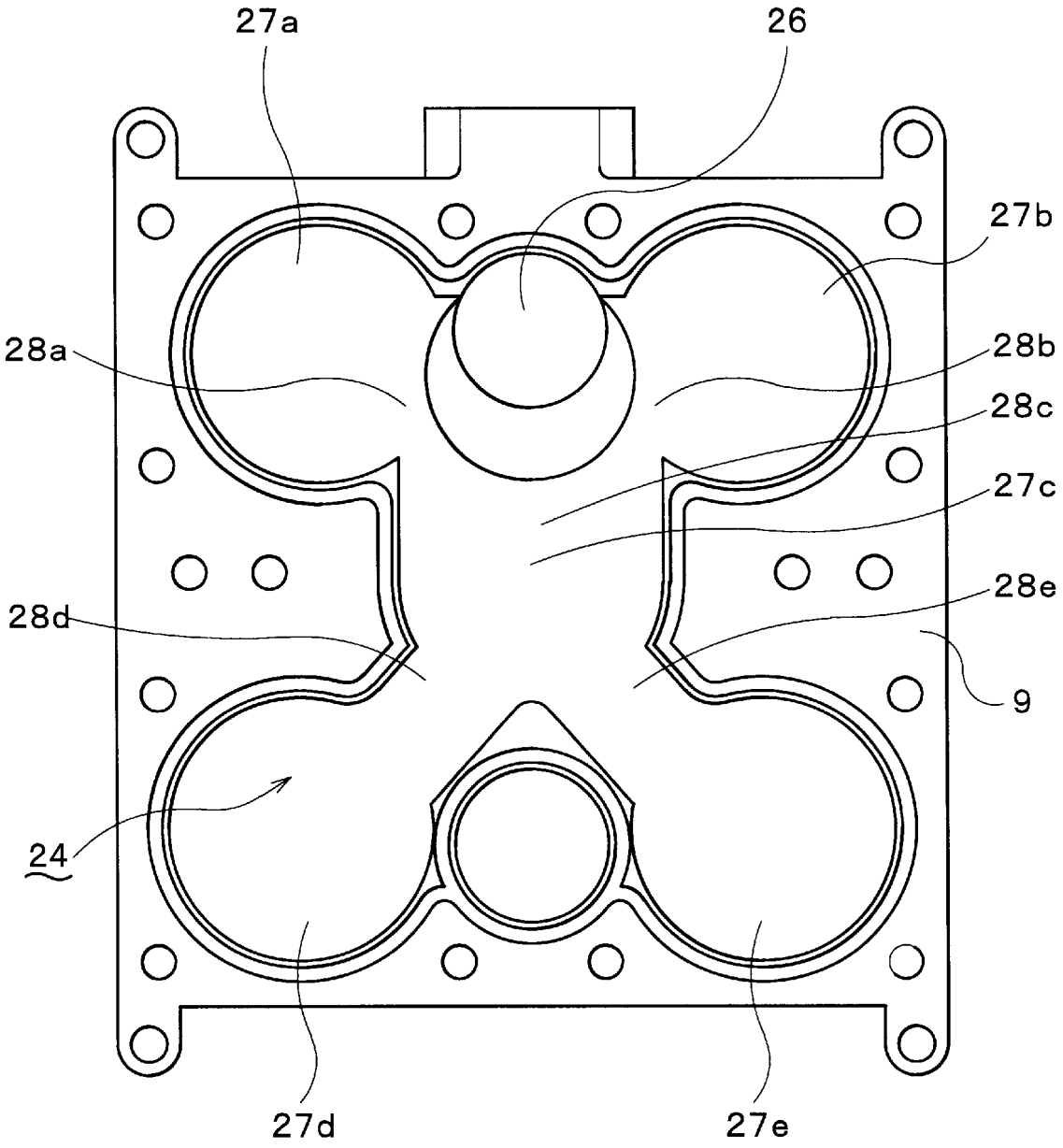
FIG. 7 is a front view of outside block seen from intermediate block side in humidifier regarding to one embodiment of the present invention.
Figure 8:
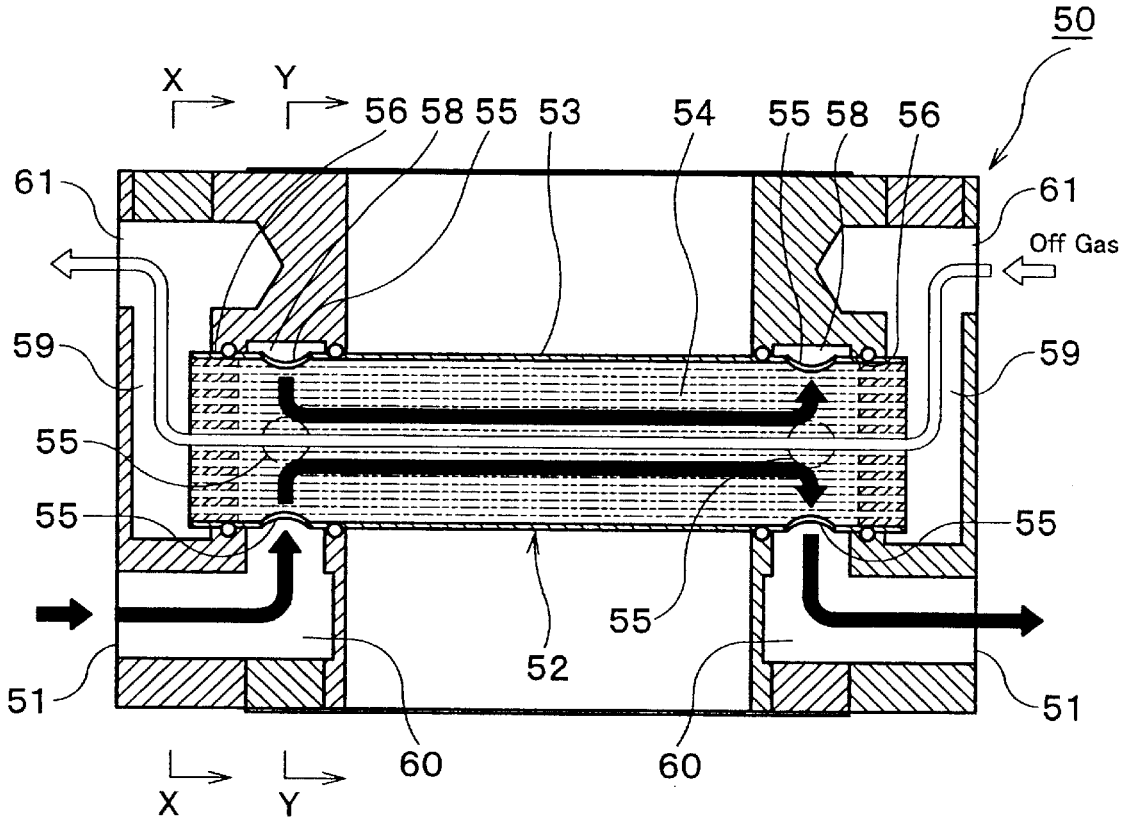
FIG.8 PRIOR ART
FIG. 8 is cross sectional view to indicate conventional humidifier.
Figure 9:
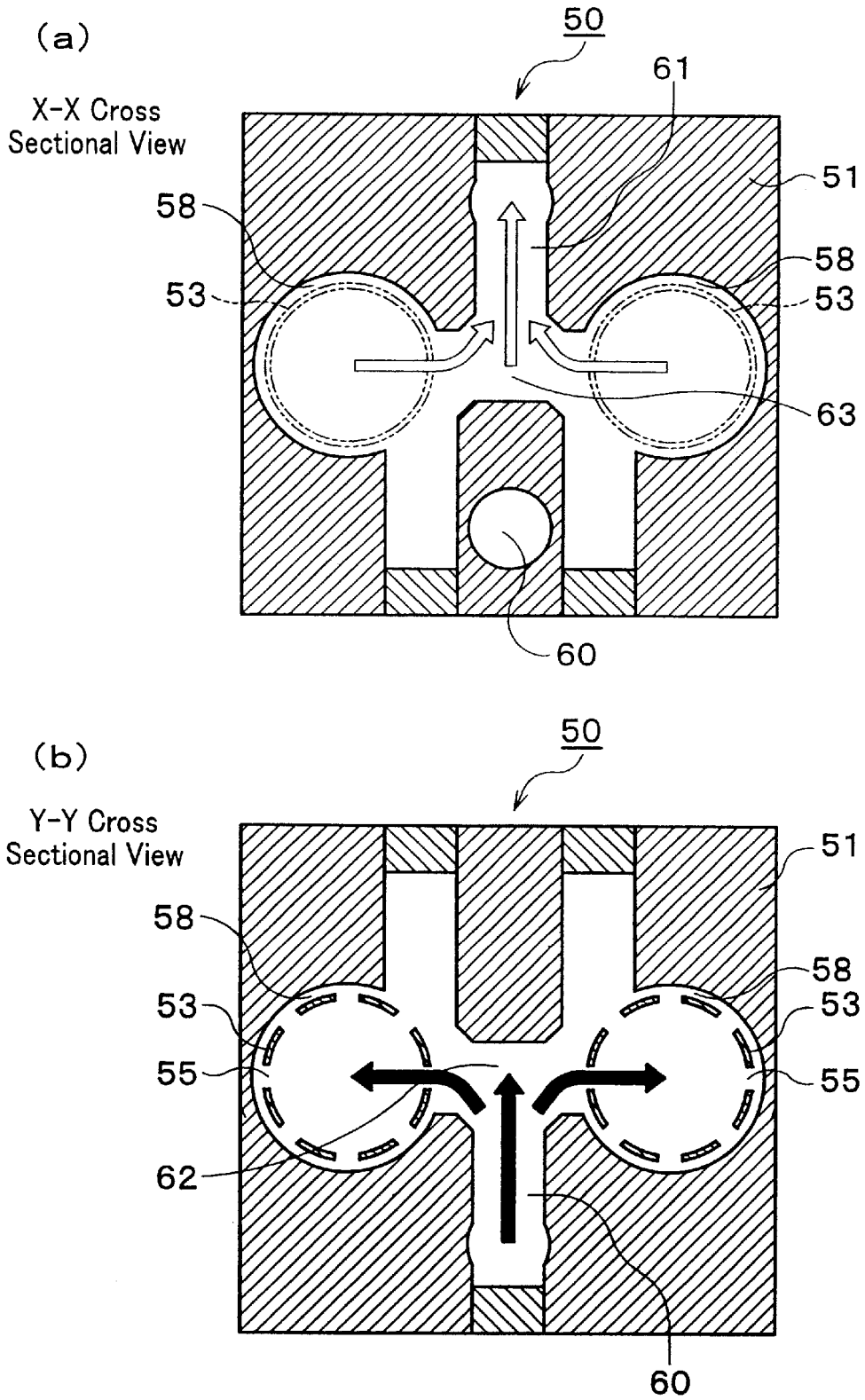
FIG.9 PRIOR ART
FIG. 9 illustrates humidifier, (a) is X—X line cross sectional view of FIG. 8 and (b) is Y—Y line cross sectional view of FIG. 8.

FIG. 6 is a perspective view of connecting face of outside plate 9 seen from intermediate plate 8 side, FIG. 7 is a front view of a connecting face of outside plate 9 seen from intermediate plate 8 side. As indicating in FIG. 2, 6 and 7, the second passage 24 is sectioned in said head block 3 to circulate gas (high humidity gas) from one side to other side so that one side aperture of each hollow fiber membrane 4 of hollow membrane module 2 is inlet or outlet, other side aperture is outlet or inlet.

This second passage 24 is formed by denting a connecting face of outside plate 9, and is comprised of the second inflow portion 26 to communicate with outlet and inlet 25 for gas of said outside plate 9, a plurality of second chamber 27*a*~27*e* to communicate gas with each hollow membrane 4 facing an aperture of each hollow membrane 4, and the second common passage 28*a*~28*e* to communicate each second chamber 27*a*~27*e* with the second gas inflow portion 26 respectively, and opening sectioning wall sectioned the second common portion 28*a*~28*e* and each second chamber 27*a*~27*e* cause the both to communicate with each other, in the meantime, opening sectioning wall sectioned the second gas inflow portion 26 and the second common portion 28*a*, 28*b*, 28*c* causes the both to communicate with each other.

The route section from the center of said second gas inflow portion 26 to the entrance of each second chamber 37*a*~27*e* makes second gas inflow portion 26 upstream and makes the entrance of each second chamber 27*a*~28*e* downstream, and is established in accidence with each flow rate respectively so as to make the dent depth of said second gas flow portion 26, said second chamber 27*a*~28*e* and said second common portion 28*a*~28*e* the same, and to circulate to each second chamber 27*a*~27*e* in the passage width of second common portion 28*a*~28*e* to become equal each other.

In this case, said each second chamber 27*a*~27 is formed so as that inlet pressure to hollow passage of each hollow fiber membrane 4 is equal each other, and velocity is uniformed even in every passage section from upper to lower, concretely, In this case, concretely, the passage width is formed to become narrow as the distance is for from the center of the second inflow portion 26 so that inlet pressure to hollow passage of each hollow fiber membrane 4 is equal each other and velocity is uniformed even in every route section from the up stream to the down stream in said each second chamber 27*a*~27.

This causes the inlet pressure of gas flowing into each hollow membrane 4 (each hollow passage) to be unified, consequently, flow rate in the inlet is also uniformed. Although a flowed gas is discharged from other side of hollow fiber membrane module 2, in also outlet side, flow rate can be uniformly gathered by the second passage 24 having same structure as inlet side to discharge from inlet and outlet portion 25. Since this case of actuation has a structure to make a velocity invariable in spite of the gap between inlet and outlet, gas flows uniformly from a hollow passage of each hollow fiber membrane 4.

In this way, a humidifier 1 regarding to the embodiment, a flow velocity of a gas flowing around a plurality of peripheral aperture 6 of one end of said housing 5 is invariably uniformed, the inlet pressure for peripheral aperture 6 of one end of housing 5 is uniformed. Furthermore, the outlet pressure of gas discharging from housing 5 is nearly uniformed, at the same time, the inflow rate of outlet port is also unified, consequently, this causes a gas to stream uniformly in housing 5. At the same time, the flow velocity of the inlet of each hollow fiber membrane 4 (each hollow passage), inlet pressure, outlet and outlet flow are uniformed, consequently, moisture exchange rate of each hollow fiber member module 2 is improved, moisture exchange rate of the whole of humidifier 1 is drastically improved.

To materialize downsizing and lightening of said humidifier 1, as indicating in FIGS. 1 and 3, it is efficient to make a hollow fiber membrane module 2 for a pair of head block 3 so as to shorten the range between housing 5 and 5 adjoining as cross-stitch or triangular arrangement, shallow the depth of the first gas inflow portion 21, the first chamber 22*a*~22*e* and the first common passage portion 23*a*~23*e* in the inside plate 7, and the second inflow portion 26, a plurality of second chamber 27*a*~27*e* and the second common passage portion 28*a*~28*e* in outside plate 9 as much as possible, and enlarge the width of the first gas inflow portion 21, the first chamber 22*a*~22*e*, and the first common passage portion 23*a*~23*e* of the inside plate 7, and the second gas inflow portion 26, a plurality of second chamber 27*a*~27*e*, and the second common passage portion 28*a*~28*e* of outside plate 9 as much as possible.

In this case, outside plate 9, intermediate plate 8 and inside plate 7 can be comprised of resin due to lightening, furthermore, especially the portion needed for strength, for example, only outside plate 9 can be comprised of metal.

Furthermore, to improve a productivity of a pair of said head block 3, although said first passage 19 and second passage 24 can be formed by notching of NC machine, etc, when each part of said head block 3 is made of metal, forming by casting is desirable, also, when forming out of resin, the injection forming is desirable.

Of course, as indicating in FIG. 1, a face of fit for each housing 5 and shaft supporting hole 11, 12, that is to say, it is desirable that O ling 29 is established as sealant bearing in outside surface, a sealant portion 30 such as seam and gasket is established in a connecting face between intermediate plate 8 and inside plate 7 and a connecting face between intermediate plate 8 and outside plate 9 for securing an air tightness of said first passage 19 and second passage 24.

Moreover, in the present embodiment, intermediate plate 8 is installed in between inside plate 7 and outside plate 9 to comprise as if shutting off the first passage 19 from the second passage 24, however, abolishing intermediate plate 8 can be practical depending upon the allocation of hollow fiber membrane module 2.

What is more, when said humidifier 1 is used as humidifier of fuel cell (not shown) equipped with vehicle, etc, a supply gas passage for supplying a fuel gas to a fuel cell is divided to be connected with the first inflow port 21 of a pair of head block 3 respectively, similarly, exhaust gas passage to discharge exhaust gas from fuel cell is divided to be connected with the second inflow port 26 of a pair of head block 3 respectively. Consequently, moisture of exhaust air withdrew into supplying air causes solid macromolecular distinguished cathode pole with anode pole of fuel cell to be humidified for stably generating electricity by a prescribed chemical reaction.

In this way, several kinds of alternation for the present invention is available unless the content is strayed, the present invention is reasonably deserved to this modified invention.

As descried in said embodiment, in the present invention described in claim 1, sectioning said first passage and second passage by denting contact surface of a plurality of plates polymerized each other leads easy manufacturing and assembling due to possibility to form the first and second passage with opening outside.

What is more, in the present invention described in claim 2, it is possible to equalize an inlet pressure for each peripheral apertures of one end of the housing as equalization of a flow velocity (inflow velocity) of the down stream of the first passage for a plurality of apertures of one end of said housing, specifically, as invariable inlet velocity for each peripheral apertures by comprising said down stream so that velocity Is uniformed even in every flow section from the up stream to the down stream for each peripheral apertures of the down stream portion of this first passage, in the meantime, for each peripheral apertures formed on one end of said housing, forming the down stream portion of said first passage to intake gas as chamber shape radially surrounding along each peripheral apertures. Furthermore, since the up stream portion of chamber-shaped of said first passage to inflow gas for each peripheral aperture in the other end of housing is formed so that a flow velocity is uniformed even in every route section from the up stream to the down stream for each peripheral aperture, this causes the outlet pressure of each peripheral aperture in the other end of housing to equalize, consequently, gas can be stream uniformly in the housing. Accordingly, moisture is uniformly exchanged for a plurality of hollow fiber membrane contained in a housing, moisture exchanging rate of the whole of humidifier is drastically improved.

What is claimed is:

1. A humidifier comprising:

a cylindrical housing having a plurality of hollow fiber membranes inserted therein, a plurality of peripheral apertures disposed thereon, and, both ends of which are opened;

a first plate having an indentation portion on a part of the surface, and a second plate having an indentation portion on a part of the surface, a plurality of plates including said first and second plates being overlapped whereby the indentation portion of said first plate forms a first passage and the indentation portion of said second plate forms a second passage, said first passage being connected to said peripheral apertures and said second passage being connected to both ends of said open ends of the housing whereby moisture-exchange occurs between a first fluid passing through said first passage to be introduced into the outside of said hollow fiber membranes and a second fluid passing through said second passage to be introduced into the inside of said hollow fiber membranes.

2. A humidifier comprising:

at least one hollow fiber membrane module formed by inserting into a cylindrical housing, both ends of which are opened, a bunch of water-permeable hollow fiber membranes along the axis of said housing, fixing both ends of said bunch at the outer circumference sides onto both ends of said housing at the inner circumference sides by means of a resin to thereby block the ends of said housing so as to form a plurality of peripheral apertures which are communicated within said housing at several intervals in the circumferential direction, a first passage which allows gas for flowing from one end of said peripheral apertures to the other end thereof serving as an inlet and an outlet, a second passage which allows gas for flowing from one end to the other end of the bunch of said hollow fiber membrane;

said first passage and said second passage being sectioned by a plurality of overlapped plates in an indentation state.

3. The humidifier as claimed in claim 2, wherein a lower portion of said first passage for allowing the gas for flowing towards respective peripheral apertures formed on one end of said housing is formed in a chamber state which surrounds the respective peripheral apertures along with the circumferential direction in such a manner that the flowing rate become the same at all cross-sections of said first passage from upstream to downstream, and an upper portion of said first passage for allowing the gas for flowing towards respective peripheral apparatuses formed on one end of said housing is formed in a chamber state which surrounds one end of said housing is formed in a chamber state which surrounds the respective peripheral aperture along with the circumferential direction in such a manner that the flowing rate become the same at all cross-sections of said first passage from the upstream to the downstream.

* * * * *